US006484326B1

(12) United States Patent
Leaphart, Jr. et al.

(10) Patent No.: US 6,484,326 B1
(45) Date of Patent: Nov. 26, 2002

(54) COMPRESSED AIR DRAIN OPENING DEVICE

(75) Inventors: J. Kirk Leaphart, Jr., Greenville, SC (US); C. Mark Leaphart, Greenville, SC (US)

(73) Assignee: 2L Products, Inc., Greenville, SC (US)

( * ) Notice: Subject to any disclaimer, the term of this patent is extended or adjusted under 35 U.S.C. 154(b) by 0 days.

(21) Appl. No.: 09/850,275

(22) Filed: May 7, 2001

(51) Int. Cl.[7] ..... E03D 9/00
(52) U.S. Cl. ..... 4/255.02; 4/255.01
(58) Field of Search ..... 4/255.01, 255.02, 4/255.03; 92/66

(56) References Cited

U.S. PATENT DOCUMENTS

| | | | | | |
|---|---|---|---|---|---|
| 886,353 | A | * | 5/1908 | Darling | 4/255.03 |
| 1,684,880 | A | | 9/1928 | Norton | 4/255.02 |
| 1,706,315 | A | | 3/1929 | Norton | 5/255.02 |
| 3,934,280 | A | | 1/1976 | Tancredi | 4/255.02 |
| 4,096,597 | A | | 6/1978 | Duse | 4/255.01 |
| 4,186,451 | A | | 2/1980 | Ruo | 4/255.02 |
| D292,631 | S | | 11/1987 | Tash | D32/14 |
| 5,199,114 | A | | 4/1993 | Christopher | 4/255.02 |
| D364,251 | S | | 11/1995 | Novak | D32/35 |
| 5,522,094 | A | | 6/1996 | Balazs | 4/255.02 |
| 5,940,897 | A | | 8/1999 | James | 4/255.02 |

FOREIGN PATENT DOCUMENTS

| | | | | |
|---|---|---|---|---|
| FR | 2371588 | * | 7/1978 | 4/255.01 |

* cited by examiner

*Primary Examiner*—Robert M. Fetsuga
(74) *Attorney, Agent, or Firm*—Joseph T. Guy; Nexsen Pruet Jacobs & Pollard, LLC

(57) ABSTRACT

An air plunger is described. The air plunger comprises an upper barrel and a lower barrel slidably received by the upper barrel. An air seal is fixed to the lower barrel and slidably engages with the upper barrel. A nozzle is attached to the lower barrel opposite to the upper barrel. A stop mechanism prohibits the upper barrel from disassociating with the lower barrel.

19 Claims, 10 Drawing Sheets

COMPRESSED AIR DRAIN OPENING DEVICE

TECHNICAL FIELD

The present invention is related to an improved drain opening device which utilizes compressed air to free a clogged drain.

BACKGROUND

Water drains typically clog due to materials becoming lodged in the traps, joints or other locations. Typically, a clog can be freed by applying pressure on the upper extent of the drain. There are a multitude of devices available for applying pressure yet they are all deficient in one manner or another.

Devices commonly referred to as "plungers" comprise a force cup with a handle attached thereto. The force cup is brought into contact with the drain entrance and pushed down by the handle thereby forcing water to contact the clog with pressure. A force cup device typically does not have a sufficient volume to apply enough pressure on the clog to be effective. Exemplary force cup devices are disclosed in U.S. Pat. Nos. 1,706,315; Des. 364,251 and Des. 292,631. The low pressure exerted by force cup devices has led to the development of other types of devices.

Piston devices comprising a piston slidably received within a cylinder are an improvement over force cup devices. The piston devices typically comprise a fixed tube with a piston that transits therein to apply pressure at the exit end of the tube. Examples include U.S. Pat. Nos. 1,684,880; 3,934,280; 4,186,451; 5,199,114; 5,522,094 and 5,940,897. These devices are often adequate for unclogging drains yet they require many parts and multiple seals thereby increasing the cost of manufacture and the susceptibility of failure. Each piston must have a seal between the piston and the outer tube to be effective. The piston must also be sealed to the push rod. Furthermore, the upper end of the tube must have a leak to allow air to enter above the piston to avoid a pressure decrease above the piston which would work against the downward force. These devices, while functional, have yet to receive widespread acceptance over the plunger.

A telescoping tube drain opening device is disclosed in U.S. Pat. No. 4,096,597. The telescoping tube drain opening device utilizes water as a pressure source and has an internal membrane incorporated in the upper tube. This device has several deficiencies. The use of water to dislodge the elements clogging a drain causes additional problems. First, it is not uncommon for the sink, or toilet, to be close to full when the effort to dislodge the clog is initiated. If a water source is used the additional water may cause the sink, or toilet, to overflow which is highly undesirable. It is not uncommon for the unclogging operation to have to be repeated which further exasperates the problem of adding additional water to the clogged appliance. If water from the clogged device is used the spoiled water is drawn into the telescoping tubes which causes problems such as trapped bacteria and other oderiferous material. The flap valve is also a point of deficiency. If water is carried from a separate source the flap valve is prone to leaking. Furthermore, after the water is discharged the flap valve will no longer be under pressure and will therefore seal with some amount of spoiled water trapped therein.

There has been a long felt desire in the art for a device suitable for unclogging drains which is economical, efficient and sanitary.

SUMMARY

It is an object of the present invention to provide a device for unclogging drains which is economical to manufacture.

It is another object of the present invention to provide a device for unclogging drains which can provide a high pressure directly to the clog and drain.

A particular feature of the present invention is the reliance on minimal moving parts and simplicity of operation.

Yet another feature of the present invention is the cleanliness of the apparatus since spoiled water cannot be easily trapped in the interior of the device.

These and other advantages, as will be realized, are provided in an air plunger. The air plunger comprises an upper barrel and a lower barrel slidably received by the upper barrel. An air seal is fixed to the lower barrel and slidably engages with the upper barrel. A nozzle is attached to the lower barrel opposite to the upper barrel. A stop mechanism prohibits the upper barrel from disassociating with the lower barrel.

Another embodiment is provided in a compressed air plunger. The compressed air plunger comprises an upper barrel and a lower barrel slidably received by the upper barrel. A force handle is attached to the upper barrel. A nozzle engages with the drain. When the force handle is pushed towards the nozzle air pressure is exerted on the drain.

Yet another embodiment of the present invention is provided in a storable apparatus for unclogging a drain. The apparatus comprises an air plunger comprising an upper barrel; a lower barrel slidably received by the upper barrel and a nozzle which engages with the drain. The holder comprises a protrusion which is receivable in the nozzle.

DETAILED DESCRIPTION

The invention will be described with reference to the drawings wherein similar elements are numbered accordingly.

Figure 1:
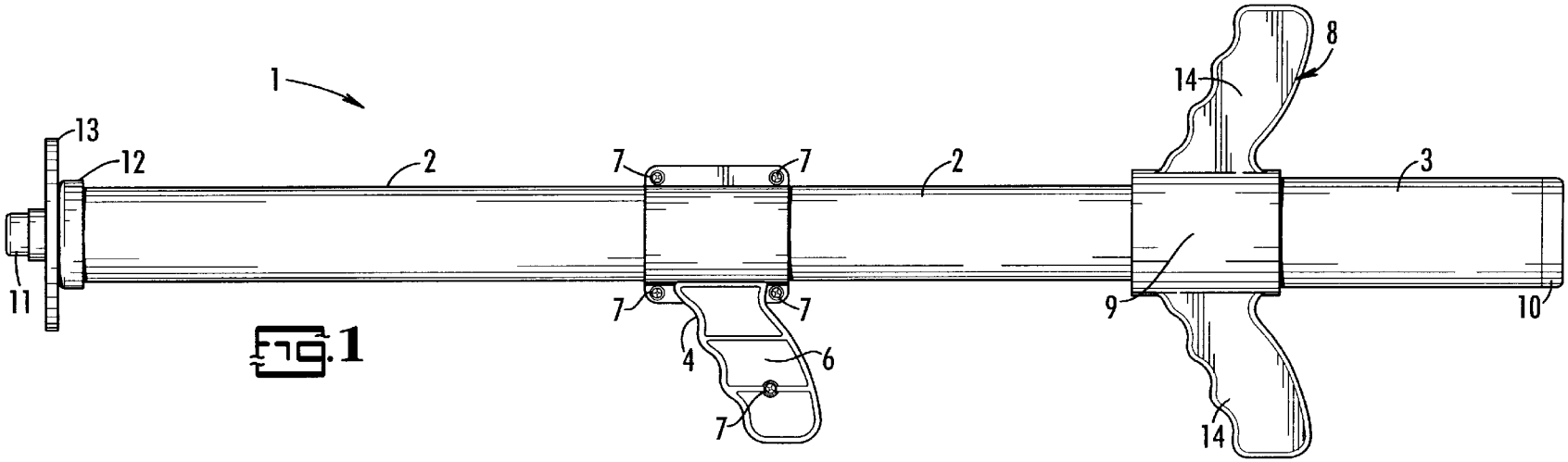
FIG. 1 is a side view of an embodiment of the compressed air plunger.

A compressed air plunger of the present invention, generally represented at 1, is shown in side view in FIG. 1. The compressed air plunger, 1, comprises a lower barrel, 2, and an upper barrel, 3, which slidably receives the lower barrel therein. Attached circumferentially to the lower barrel, 2, is a preferred alignment handle, 4. The alignment handle, 4, preferably comprises a collar, 5, with an alignment grip, 6, integral thereto. The alignment handle, 4, is preferably two matching components secured together with attachment elements, 7, as will be further described herein. The alignment handle may also be integral to the lower barrel. Attached circumferentially to the upper barrel, 3, is preferably a force handle, 8. The force handle, 8, comprises a collar, 9, with a pair of force grips, 14, integral thereto and preferably arranged symmetrical about the central axis of the compressed air plunger, 1. The upper end of the upper barrel preferably comprises a cap, 10, which seals the upper barrel. The lower end of the lower barrel comprises a spout, 11, with an attachment collar, 12, integral thereto. A seal disk, 13, receives the spout, 11. In operation, the user places one hand on a force grip, 14, and the other hand on the alignment grip, 6. The spout, 11, of the compressed air plunger is brought into close proximity of the drain. Once in the proper position, as would be apparent to one of ordinary skill in the art, the hand on the alignment grip is placed on the vacant force grip, 14. As the force grips are pressed downward towards the alignment handle, 4, the seal disk, 13, conforms with and seals the drain opening and air is forced from the variable volume cylinder formed by the combined upper barrel and lower barrel through the spout and into the clogged drain pipe. The pair of force grips, 14, insures that the pressure can be applied evenly without danger of displacing the compressed air plunger to one side or the other thereby allowing a substantial amount of force to be applied to the clogged drain safely.

Figure 2:
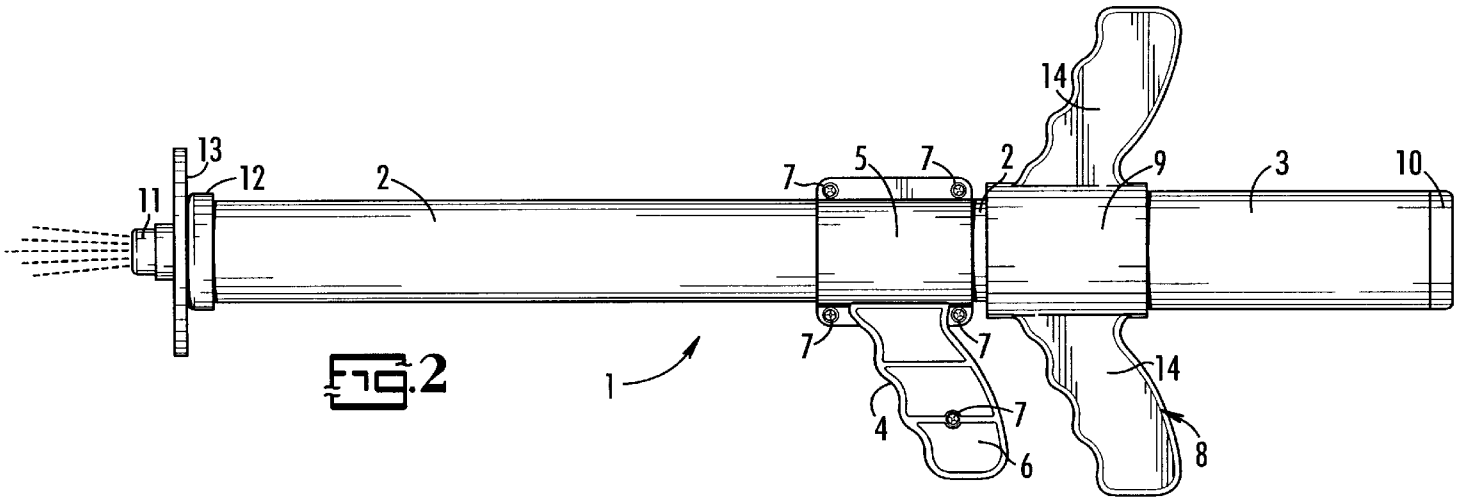
FIG. 2 is a side view of the embodiment of the compressed air plunger of FIG. 1 after discharge of the air to create pressure in the drain.

A side view of the compressed air plunger after expelling the air from the nozzle is shown in FIG. 2. In FIG. 2 the force grips, 14, and associated collar, 9, have been pushed downward towards the alignment handle, 4. The upper barrel, 3, which is attached to the collar, 9, of the force grip, 8, follows with the alignment handle. As would be apparent from the description herein, and illustrations, the pressure is created by the volume of air displaced in the combined barrels.

Figure 3:
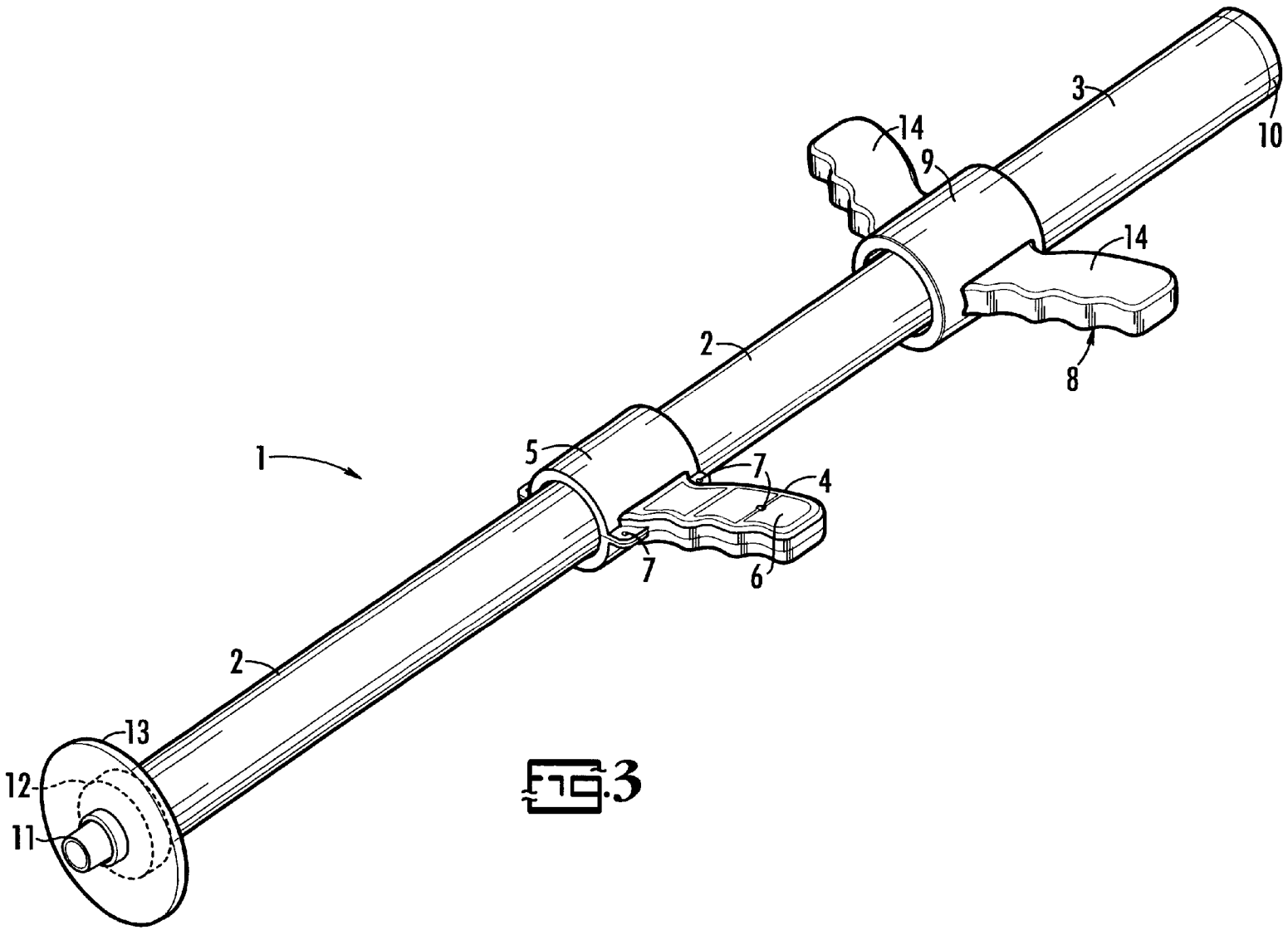
FIG. 3 is a front perspective view of the embodiment of the compressed air plunger of FIG. 1.

FIG. 3 is a front perspective view of the compressed air plunger of FIG. 1. In FIG. 3 the seal disk and nozzle can be more readily visualized.

Figure 4:
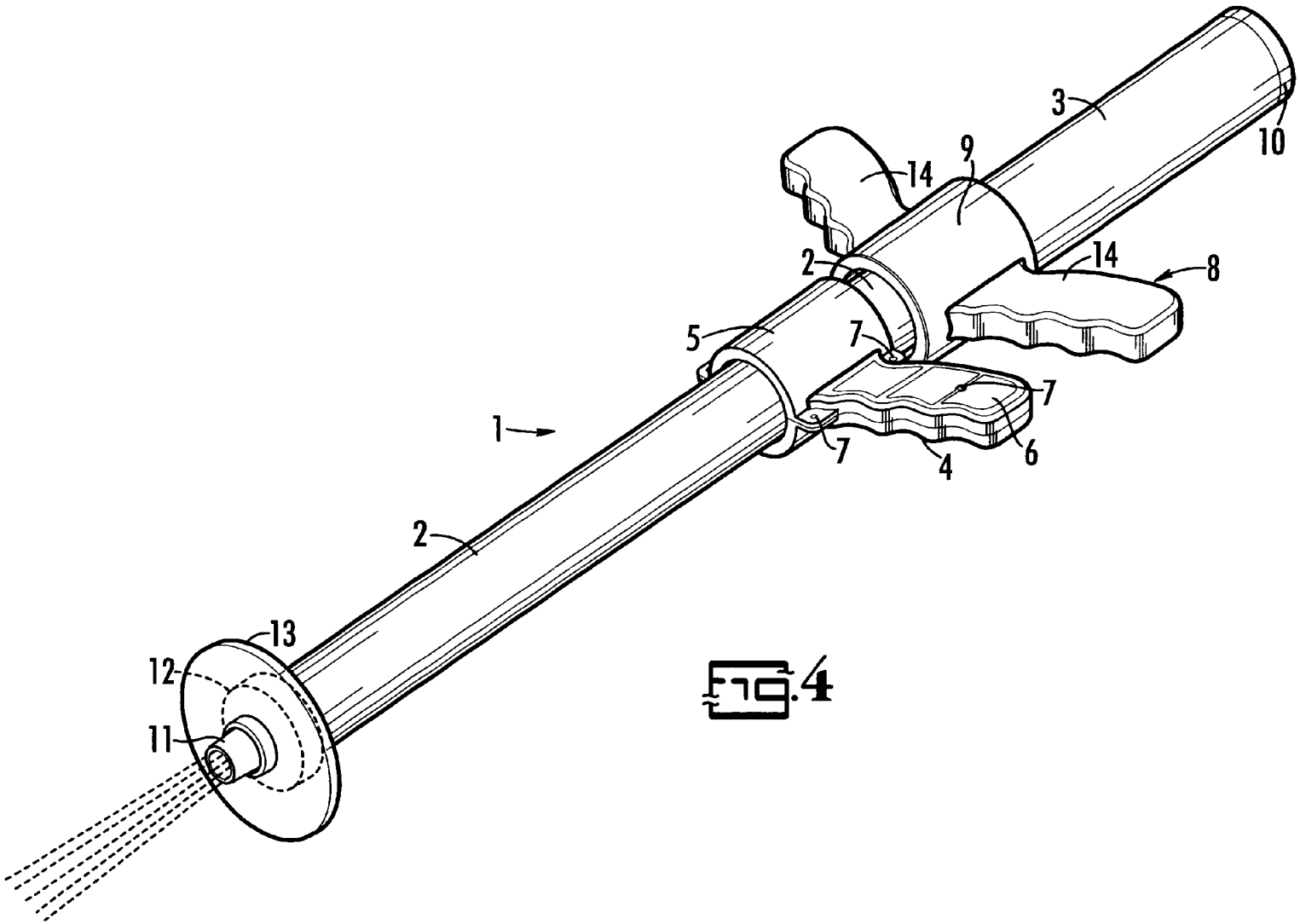
FIG. 4 is a front perspective view of the embodiment of the compressed air plunger of FIG. 3 after discharge of the air to create a pressure in the drain.

FIG. 4 is a front perspective view of the compressed air plunger of FIG. 2 after the upper barrel has been moved to a position which decreases the total volume in the variable volume cylinder thereby forcing air out of the nozzle.

Figure 5:
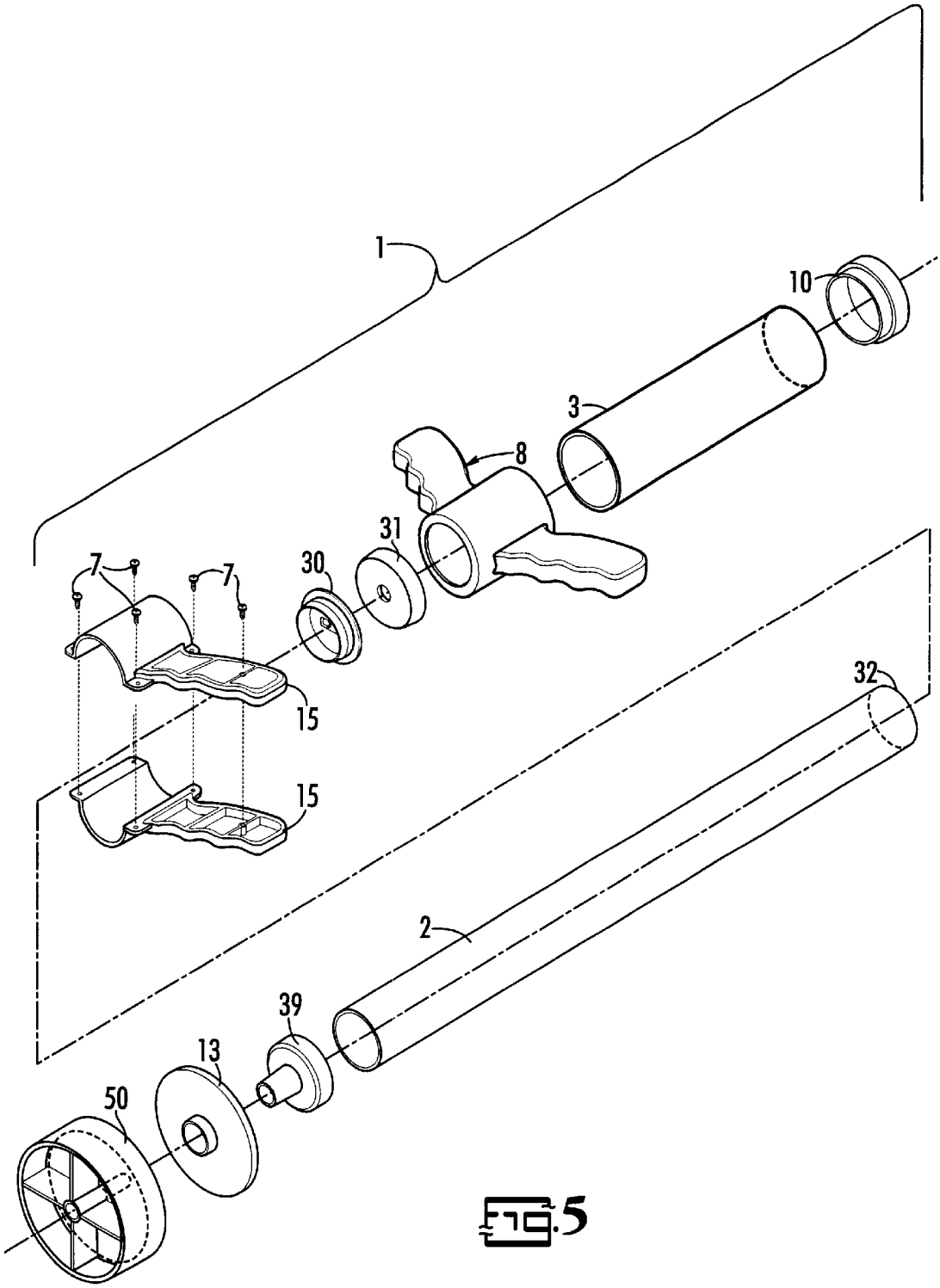
FIG. 5 is an exploded view of the embodiment of the compressed air plunger of FIG. 1.

An exploded perspective view of an embodiment of the present invention is provided in FIG. 5.

In FIG. 5 the lower barrel, 2, is shown as a preferred hollow cylinder. Other shapes, such a trigonal, square, pentagon, hexagon, and polygonal may be employed with round being preferred mainly due to the ready availability of round tubes which can be utilized with minor modification and the simplicity with regards to formation of seals as will be apparent herein. The length of the lower barrel is chosen to insure that the alignment handle, 4, is sufficiently above the level of stagnant water and the total height of the apparatus is convenient for applying pressure to the force handles, 8, without undue discomfort. Based on determinations of the inventors it is preferred that the lower barrel be at least approximately 6 inches in length to no more than approximately 36 inches in length. More preferably, the lower barrel is at least approximately 18 inches in length to no more than approximately 30 inches in length. A lower barrel of approximately 24 inches in length has been determined to be optimal for most common uses anticipated for the compressed air plunger. The diameter of the lower barrel is chosen to balance strength and convenience of use. A barrel diameter of approximately 1 inch to approximately 5 inches has been determined to be preferable. More preferred is a barrel diameter of approximately 1 inch to approximately 3 inches with a barrel diameter of approximately 2 inches being optimal for most applications anticipated for a compressed air plunger. When a barrel is employed which is not round the diameter is taken as the longest exterior distance straight across the barrel through the central point. For a square barrel, for example, the effective diameter would be the distance between opposing comers. The wall thickness of the lower barrel is chosen for strength and cost and on the material of construction which impacts both strength and cost. It is preferred that the wall thickness be at least approximately 0.010 inches since a smaller wall thickness becomes weak when the preferred materials of construction are employed. It is preferred that the wall thickness be no more than approximately 0.10 inches since the added weight and expense is not justified when the preferred materials of construction are employed. More preferred is a wall thickness of approximately 0.040 inches to approximately 0.060 inches. The material of construction is not limiting except for the constraints of strength and cost. Most preferably the lower barrel is manufactured from plastics, or polymers. A particularly preferred polymer is polyvinylchloride due to cost, availability and weight to strength considerations. Metals may be employed but are not preferred due to factors such as convenience, cost and weight which are not associated with operation of the inventive device but are associated with aesthetics and manufacturing preference. In a particularly preferred embodiment the lower barrel is a round vinyl cylinder with an length of approximately 24 inches, an outer diameter of approximately 2 inches and a wall thickness of approximately 0.05 inches.

In FIG. 5, the upper barrel, 3, is shown as a preferred hollow cylinder. It is most preferred that the upper barrel have the same cross-sectional shape as the lower barrel for manufacturing simplicity. The length of the upper barrel is chosen to insure that sufficient pressure can be applied to the clogged drain. As would be apparent the pressure created is a function of the air displaced by the compressed air plunger. It would also be apparent that the air displaced is directly proportional to the size of the upper barrel, 3. Based on determinations made by the inventors it is preferred that the upper barrel be at least approximately 4 inches in length to no more than approximately 14 inches in length. If the upper barrel is less than approximately 4 inches in length the pressure created is less than that desired. If the barrel is longer than approximately 14 inches the device becomes unwieldy and cumbersome with minimal advantages offered. More preferably, the upper barrel is at least approximately 7 inches in length to no more than approximately 11 inches in length. A upper barrel of approximately 9 inches in length has been determined to be optimal for most common uses anticipated for a compressed air plunger. The inner diameter of the upper barrel is chosen to be slightly larger than the exterior diameter of the lower barrel with enough difference there between to insure an adequate seal. An upper barrel with an internal diameter which is at least approximately 0.05 inches larger than the exterior diameter of the lower barrel is preferred. It is preferred that the upper barrel have an internal diameter which is no more than approximately 1 inch larger than the external diameter of the lower barrel. More preferably the upper barrel has an internal diameter which is at least approximately 0.1 inches larger than the exterior diameter of the lower barrel but no more than approximately 0.7 inches larger than the exterior diameter of the lower barrel. It is most preferred that the upper barrel have an internal diameter which is approximately 0.4 inches larger than the exterior diameter of the lower barrel. The wall thickness of the upper barrel is chosen for strength and cost and on the material of construction which impacts both strength and cost. It is preferred that the wall thickness be at least approximately 0.010 inches since a smaller wall thickness becomes weak when the preferred materials of construction are employed. It is preferred that the wall thickness be no more than approximately 0.10 inches since the added weight and expense is not justified when the preferred materials of construction are employed. More preferred is a wall thickness of approximately 0.040 inches to approximately 0.060 inches. The material of construction is not limiting except for the constraints of strength and cost. Most preferably the upper barrel is manufactured from plastics, or polymers. A particularly preferred polymer is polyvinylchloride due to cost, availability and weight to strength considerations. Metals may be employed but are not preferred due to factors such as convenience, cost and weight and since these factors are not associated with operation of the inventive device. In a particularly preferred embodiment the upper barrel is an approximately 9 inch long round vinyl cylinder with an outer diameter of approximately 2.5 inches and a wall thickness of approximately 0.05 inches.

Figure 6:
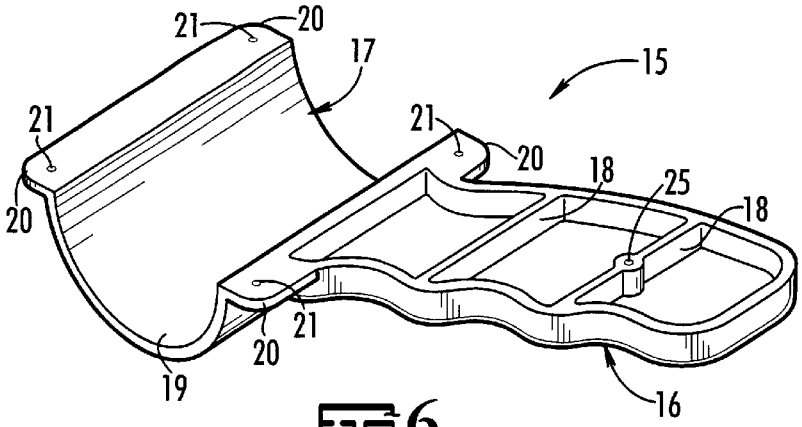
FIG. 6 is a perspective view of a preferred alignment handle blank of the present invention.
Figure 7:
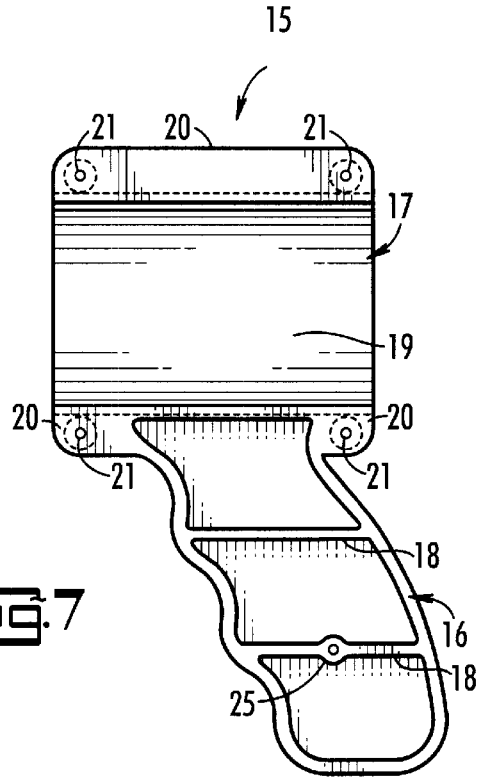
FIG. 7 is a top view of the alignment handle blank of FIG. 6.
Figure 8:
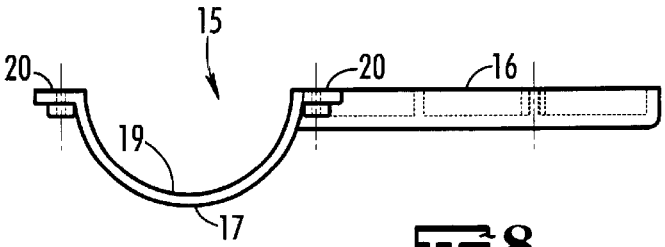
FIG. 8 is a side view of the alignment handle blank of FIG. 6.

The optional but preferred alignment handle, 4, is illustrated in FIG. 5 to be formed by a pair of matching alignment handle blanks which are shown in detail in FIGS. 6–8. A preferred alignment handle blank, 15, is shown in perspective view in FIG. 6, in top view in FIG. 7 and in front view in FIG. 8. The alignment handle blank comprises a grip portion, 16, with a collar, 17, integral thereto. When two blanks are brought together in operative contact the grip portion from each blank forms an alignment grip. The grip portion preferably comprises ribs, 18, and a mounting void, 25. The ribs from opposing grip portions add strength to the alignment grip. The mounting voids align for receipt of a mounting element (7 of FIG. 5) such that grip portions are secured one to the other. The collar, 17, comprises a rounded section, 19, within which the lower barrel will be received and tabs, 20, with mounting voids, 21, which align for receiving a mounting element (7 of FIG. 5). The mounting elements draw the two alignment handle blanks into close proximity with the lower barrel which is bound by the rounded sections. The radius of curvature of the rounded sections is chosen such that the lower barrel is secured therein with sufficient friction to prohibit the alignment handle from sliding but not so small as to cause the lower barrel to collapse. The alignment handle is illustrated as a pistol grip since this is preferred for aesthetic purposes. The alignment handle grip may comprise a pistol grip, a round grip, a square grip, or any other shape sufficient to grasp the alignment handle and guide the placement of the compressed air plunger. Since the device can be guided by placing one hand directly on the lower barrel it is understood that the lower alignment handle is a preferred option. The alignment handle may also be integral to the lower barrel as would be common if molded as a single unit. The alignment handle blanks may also be secured one to the other with an adhesive or glue, as would be apparent from the preferred materials. The alignment handle blanks may also be secured to the lower barrel by adhesive.

Figure 9:
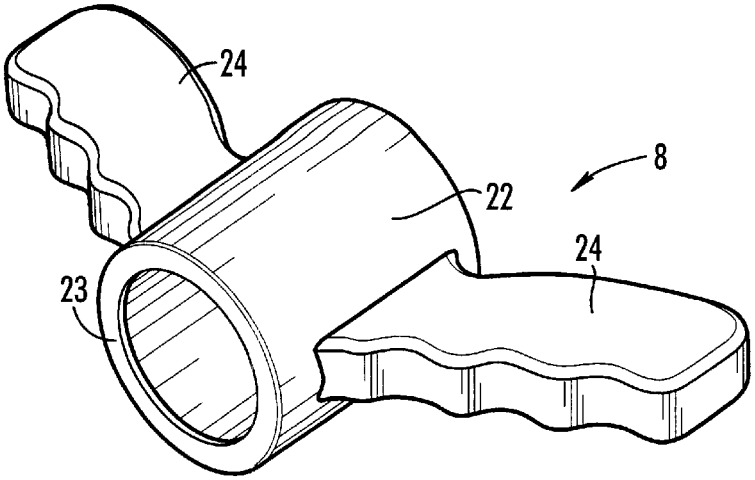
FIG. 9 is a perspective view of a preferred force handle of the present invention.
Figure 10:
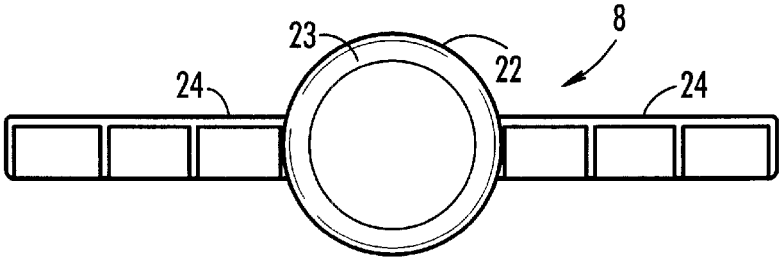
FIG. 10 is a bottom view of the force handle of FIG. 9.
Figure 11:
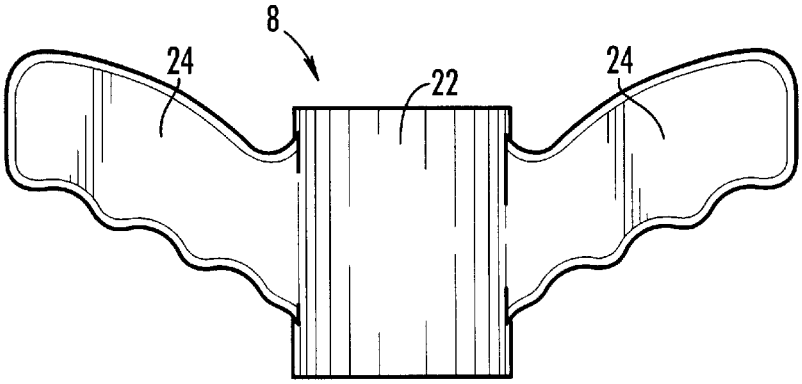
FIG. 11 is a side view of the force handle of FIG. 9.
Figure 12:
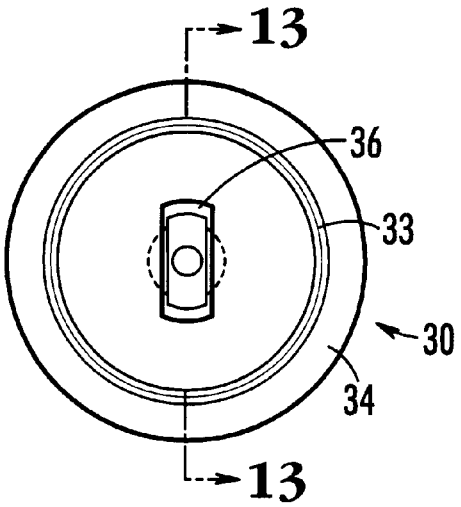
FIG. 12 is a top view of a preferred seal adapter of the present invention.
Figure 13:
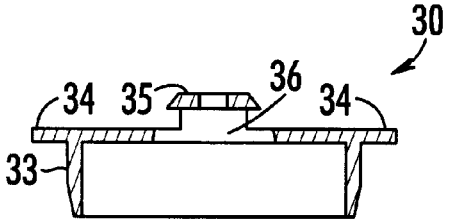
FIG. 13 is a cross-sectional side view of the seal adapter of FIG. 12.
Figure 14:
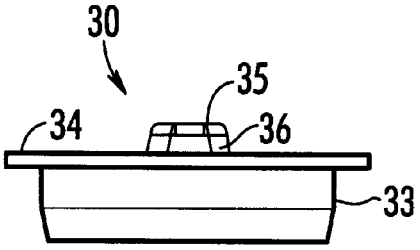
FIG. 14 is a side view of the seal adapter of FIG. 12.
Figure 15:
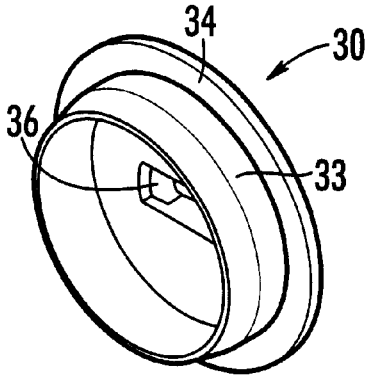
FIG. 15 is a perspective view of the seal adapter of FIG. 12.

The force handle, 8, illustrated in FIG. 5 is shown in detail in FIGS. 9–11. The force handle is shown in perspective view in FIG. 9, in front view in FIG. 10 and side view in FIG. 11. The force handle, 8, comprises a central barrel, 22, with a terminal lip, 23, which creates a restricted portion of the central barrel. The upper barrel, 3, is received in the central barrel and secured therein by glue or other attachment means as known in the art. Integral to the central barrel and symmetrically placed thereon are a pair of handles, 24. The handles are preferably shaped as a pistol grip yet other configurations are within the scope of the present invention including round, square and the like. Pistol grips are preferred for aesthetics and due to the increased control provided.

The upper terminus of the upper barrel is sealed with a cap, 10, as shown in FIG. 5. The cap, 10, is secured to the upper barrel by gluing, or adhesive or by any other methods known in the art for securing a cap to a barrel. It is contemplated that the cap may be integral to the upper barrel as would be realized if the upper barrel were molded with one end sealed.

The seal mechanism is shown in FIG. 5 to comprise two components. A seal adapter, 30, attaches to the upper end, 32, of the lower barrel, 2, and forms an air tight seal there between. The seal adapter will be described in more detail herein. Attached to the seal adapter, 30, is a piston cup, 31, which allows the upper barrel, 3, to slide thereon while maintaining a sealed compartment formed by the lower barrel and upper barrel.

The seal adapter, 30, is shown in detail in FIGS. 12–15. The seal adapter is shown in bottom view in FIG. 12, in cross-sectional view in FIG. 13, in side view in FIG. 14 and perspective view in FIG. 15. The seal adapter, 30, comprises a terminally beveled lip, 33, which is received in the upper end of the lower barrel. The terminal bevel assist in inserting the lip in the lower barrel. The lip is preferably pressed into the upper end of the lower barrel until the stop ledge, 34, contacts the edge of the lower barrel. The stop ledge, 34, is larger than the opening defined by the lip, 23, of the central barrel, 22, of the force grip, 8, illustrated particularly in FIGS. 9 and 10. Therefore, as the force grip is withdrawn to the fully extended position the stop ledge, 34, prohibits the upper barrel from being separated from the lower barrel. The seal adapter, 30, is preferably attached to the lower barrel by glue, or a suitable adhesive, since this method of attachment has the advantages of efficiency and low cost. The seal adapter, 30, has integral thereto a lug, 35, which secures the piston cup as will be realized from further discussions herein. A passage void, 36, allows air to freely pass the seal adapter as the total volume represented by the combined barrels changes as a result of the upper barrel moving up or down relative to the lower barrel.

Figure 16:
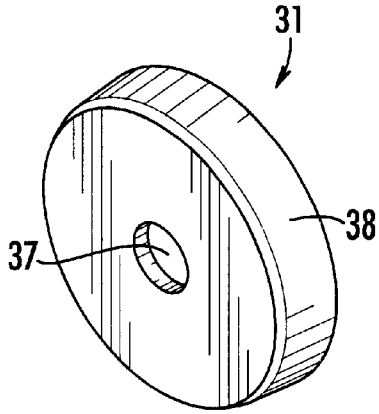
FIG. 16 is top perspective view of a preferred piston cup of the present invention.
Figure 17:
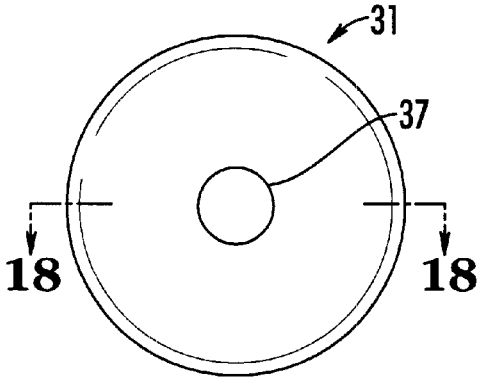
FIG. 17 is a top view of the piston cup of FIG. 16.
Figure 18:
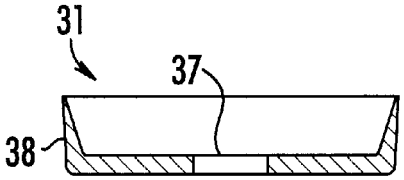
FIG. 18 is a cross-sectional side view of the piston cup of FIG. 16.

The piston cup, 31, is illustrated in detail in FIGS. 16–18. The piston cup, 31, is preferably a flexible member with a central void, 37, which is stretched for receiving the lug, 35, of the seal adapter, 30. The piston cup, 31, comprises a tapered wipe ledge, 38, which slidably engages with the interior wall of the upper barrel to form a seal. The piston cup is preferably manufactured from a pliable material with rubber being most preferred.

Figure 19:
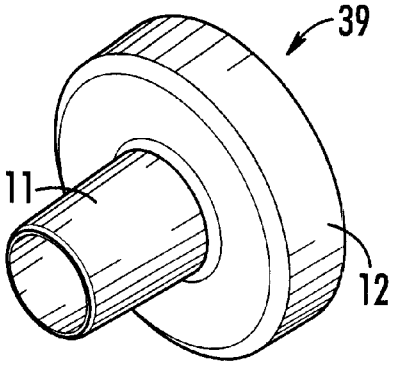
FIG. 19 is a front perspective view of a preferred seal spout of the present invention.
Figure 20:
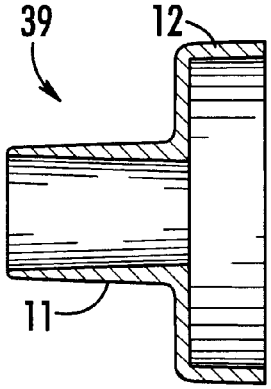
FIG. 20 is a cross-sectional side view of the seal spout of FIG. 19.
Figure 21:
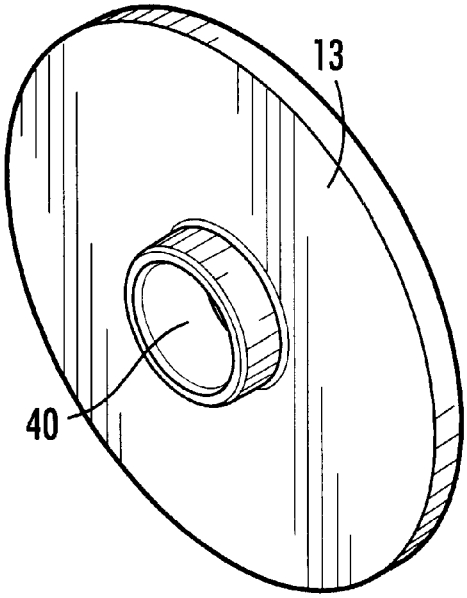
FIG. 21 is a perspective view of a preferred seal disk of the present invention.
Figure 22:
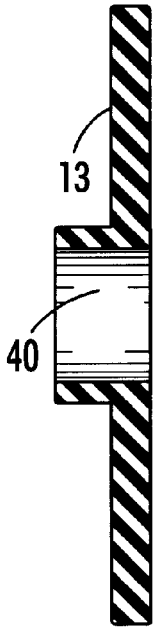
FIG. 22 is a cross-sectional side view of the seal disk of FIG. 21.

A seal spout, 39, of FIG. 5 seals the lower end of the lower barrel, 2, and preferably increases the air flow by restriction relative to the size of the lower barrel. The seal spout is described in more detail with reference to FIGS. 19 and 20. The seal spout, 39, comprises an attachment collar, 12, which is secured to the end of the lower barrel. In one embodiment the attachment collar may be integral to the lower barrel. The spout, 11, has a smaller diameter than the attachment collar, 12. It is preferred that the spout be integral to the attachment collar. In one embodiment the lower barrel, attachment collar and spout are molded as a single unit as would be apparent to one of ordinary skill in the art. The seal spout is preferably manufactured of molded polypropylene. The seal spout comprises a central void and may be tapered to eliminate trapping of spoiled water inside the device. The nozzle allows free passage of fluid, such as water and air through the central void.

A seal disk, 13, receives the spout, 11, and forms a seal between the compressed air plunger and the drain. The seal disk comprises a central void, 40, for receiving the spout, 11. The seal disk is preferably pliable allowing conformance to the shape and contour of the drain entrance. The seal disk is preferably manufactured from a pliable material, most preferably rubber.

Figure 23:
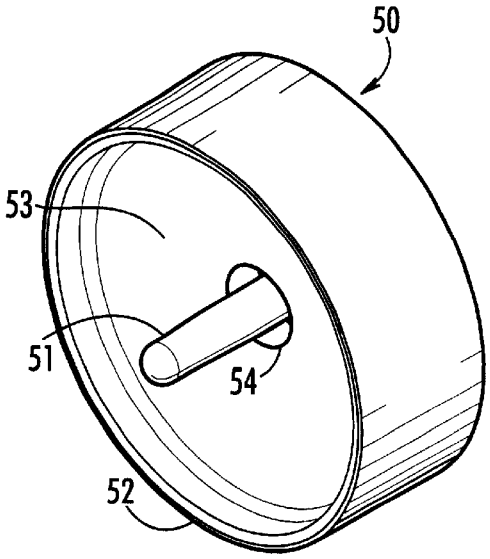
FIG. 23 is a top perspective view of a preferred holder of the present invention.
Figure 24:
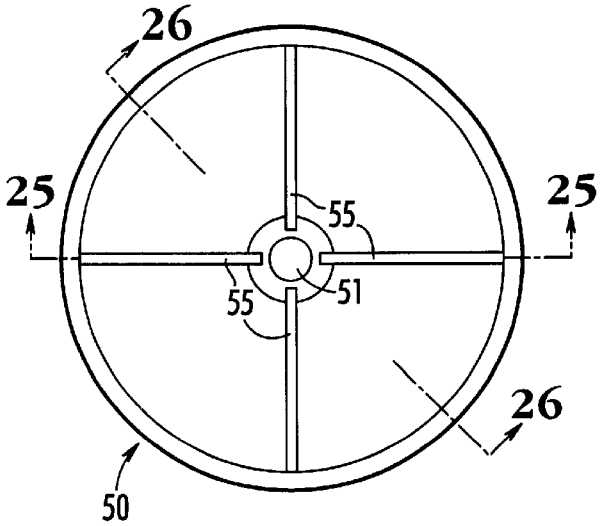
FIG. 24 is a bottom view of the holder of FIG. 23.
Figure 25:
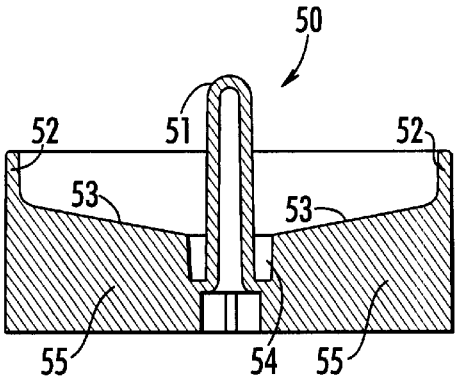
FIG. 25 is a cross-sectional view of the holder taken along line 25—25 of FIG. 24.
Figure 26:
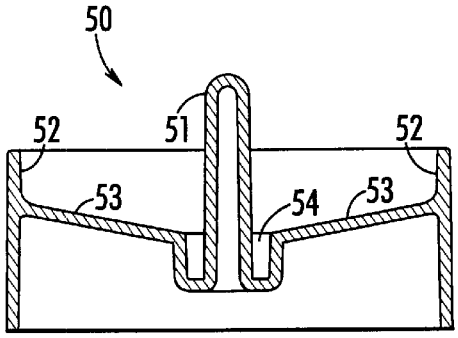
FIG. 26 is a cross-sectional view of the holder taken along line 26—26 of FIG. 24.

A holder, 50, provides a convenient location for storing the compressed air plunger. The holder, 50, will be described in detail by referring to FIGS. 23–26. The holder is shown in perspective view in FIG. 23, in bottom view in FIG. 24 and in cross-sectional views in FIGS. 25 and 26. The holder is shaped primarily like a bowl with a central protrusion, 51, which is received by the nozzle, 11, during storage of the compressed air plunger. The exterior of the holder comprises a wall, 52. The wall insures that any fluid dripping from the compressed air plunger is contained within the holder, 50. The holder further comprises a floor, 53, which preferably slopes downward from the wall towards a central moat, 54. The sloping floor and moat are taken together to increase the volume of dripping water the holder can contain. Below the floor, 53, and integral thereto, are preferred fins, 55, to increase the strength of the holder. The holder is preferably molded as a single element although it is within the scope of the present invention to mold separate elements which are combined to form the holder. It is preferred that the holder be manufactured from a plastic with polypropylene being most preferred.

The invention has been describe with emphasis directed to the preferred embodiments. It would be apparent from the description herein that various embodiments could be developed without departing from the scope of the invention. Alternate methods of construction, operation and use could also be employed without departing from the scope of the invention which is set forth in the claims which follow.

What is claimed is:

1. An air plunger comprising:

an upper barrel;

a lower barrel slidably received by said upper barrel;

an air seal fixed to said lower barrel and slidably engaged with said upper barrel;

a nozzle attached to said lower barrel opposite to said upper barrel; and a stop mechanism for prohibiting said upper barrel from disassociating with said lower barrel.

2. The air plunger of claim 1 wherein said air seal comprises a seal adapter secured to said lower barrel.

3. The air plunger of claim 2 wherein said seal adapter comprises a stop ledge extending beyond said lower barrel.

4. The air plunger of claim 3 wherein said barrel comprises a force handle and said force handle comprises a terminal lip and said terminal lip contacting said stop ledge is said stop mechanism.

5. The air plunger of claim 2 further comprising a piston cup attached to said seal adapter.

6. The air plunger of claim 1 wherein said barrel comprises a force handle.

7. The air plunger of claim 6 wherein said force handle comprises a terminal lip.

8. The air plunger of claim 1 wherein said lower barrel further comprises an alignment handle.

9. The air plunger of claim 1 further comprising a seal disk.

10. The air plunger of claim 9 wherein said seal disk receives said nozzle.

11. A compressed air plunger comprising:

an upper barrel;

a lower barrel slidably received by said upper barrel;

a force handle attached to said upper barrel;

a nozzle engageable with a drain;

wherein when said force handle is pushed towards said nozzle air pressure is exerted on said drain; and a seal disk wherein said seal disk comprises a void for receiving said nozzle wherein when said force handle is pushed towards said nozzle said seal disk contours to said drain.

12. The compressed air plunger of claim 11 further comprising a seal adapter attached to said lower barrel wherein said seal adapter comprises a lug and an air passage void.

13. The compressed air plunger of claim 13 further comprising a piston cup comprising a central void for receiving said lug wherein said piston cup slidably engages with said upper barrel thereby forming a sliding seal.

14. A storable apparatus for unclogging a drain comprising:

an air plunger comprising:

an upper barrel;

a lower barrel slidably received by said upper barrel; and a nozzle engageable with said drain; and a holder comprising a protrusion which is receivable in said nozzle.

15. The storable apparatus of claim 14 wherein said holder comprises a central protrusion.

16. The storable apparatus of claim 15 wherein said holder comprises a moat circumventing said central portion.

17. The storable apparatus of claim 16 comprising a floor sloping downward towards said moat.

18. The storable apparatus of claim 14 wherein said holder is polypropylene.

19. An air plunger comprising:

an upper barrel;

a lower barrel slidably received by said upper barrel;

an air seal between said upper barrel and said lower barrel wherein said upper barrel and said lower barrel form a variable volume cylinder;

a nozzle attached to said lower barrel opposite to said upper barrel;

wherein when said upper barrel is pushed towards said nozzle said variable volume chamber decreases in size and air is expelled through said nozzle from said variable volume chamber.

* * * * *